US010858778B2

(12) United States Patent
Wielstra et al.

(10) Patent No.: US 10,858,778 B2
(45) Date of Patent: Dec. 8, 2020

(54) TREATMENT PLATE FOR A GARMENT TREATMENT APPLIANCE

(71) Applicant: KONINKLIJKE PHILIPS N.V., Eindhoven (NL)

(72) Inventors: Ytsen Wielstra, Eindhoven (NL); Lanying Ji, Eindhoven (NL); Jiecong Tang, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 58 days.

(21) Appl. No.: 16/086,350

(22) PCT Filed: Mar. 16, 2017

(86) PCT No.: PCT/EP2017/056186

§ 371 (c)(1),
(2) Date: Sep. 19, 2018

(87) PCT Pub. No.: WO2017/162503

PCT Pub. Date: Sep. 28, 2017

(65) Prior Publication Data

US 2019/0100868 A1 Apr. 4, 2019

(30) Foreign Application Priority Data

Mar. 21, 2016 (EP) ..... 16161399

(51) Int. Cl.
*D06F 75/38* (2006.01)
*C23C 18/12* (2006.01)

(52) U.S. Cl.
CPC ..... *D06F 75/38* (2013.01); *C23C 18/1216* (2013.01); *C23C 18/1254* (2013.01)

(58) Field of Classification Search
CPC ..... D06F 75/00; D06F 75/38; C23C 18/1216; C23C 18/1254; B05D 3/00; B05D 3/002; B05D 1/00
See application file for complete search history.

(56) References Cited

U.S. PATENT DOCUMENTS 3,953,178 A * 4/1976 Engel ..... C21D 1/09 428/627
6,005,705 A * 12/1999 Schmidt ..... C08G 77/46 252/519.31

(Continued)

FOREIGN PATENT DOCUMENTS

WO 2009105945 A1 9/2009
WO 2014079982 A1 5/2014
WO 2014122022 A1 8/2014

OTHER PUBLICATIONS

J. Livage, "Redox Reactions in Transition Metal Oxide Gels", Journal of Sol-Gel Science and Tehchnology 1:21-33, 1993.

*Primary Examiner* — Ismael Izaguirre

(57) ABSTRACT

The invention provides a treatment plate (10) for a garment treatment appliance (100), the treatment plate (10) having a contact surface (13) that in use slides on a garment (200) being treated, the contact surface (13) comprising a coating (20) comprising a metal oxide coating (21), the metal oxide coating (21) comprising: —first metal ions selected from the group consisting of titanium (Ti), zirconium (Zr), hafnium (Hf), scandium (Sc), and yttrium (Y); and—second metal ions selected from the group consisting of cerium (Ce), manganese (Mn), and cobalt (Co). This invention provides a favorable gliding behavior.

20 Claims, 4 Drawing Sheets

(56) References Cited

U.S. PATENT DOCUMENTS

| | | | | |
|---|---|---|---|---|
| 2004/0172868 | A1 | 9/2004 | Boulud | |
| 2011/0070376 | A1* | 3/2011 | Wales | A01N 63/00<br>427/414 |
| 2013/0247430 | A1 | 9/2013 | Paccaud | |
| 2014/0120284 | A1 | 5/2014 | Perillon | |

* cited by examiner

TREATMENT PLATE FOR A GARMENT TREATMENT APPLIANCE

This application is the U.S. National Phase application under 35 U.S.C. § 371 of International Application No. PCT/EP2017/056186, filed on Mar. 16, 2017, which claims the benefit of International Application No. 16161399.7 filed on Mar. 21, 2016. These applications are hereby incorporated by reference herein.

FIELD OF THE INVENTION

The invention relates to the field of garment care, in particular to a treatment plate for a garment treatment appliance.

BACKGROUND OF THE INVENTION

Low friction coatings for garment care treatment plate are known in the art. Low friction coatings allow contacting surfaces to rub against one another with reduced friction, reducing e.g. the effort to move garment treatment appliances, like dewrinkling devices, such as an iron, or a steamer. Further, a scratch resistant coating may be very important for electrical appliances, and also for non-electrical domestic appliances, such as pans, oven plates and the like, that benefit from low friction. Hence, the use of coatings with low friction coefficient and good scratch resistance, to improve the tribological properties of appliance surfaces, is constantly increasing.

An example of a treatment plate for a garment treatment appliance for treating garments is the soleplate of an iron. In general, a separate layer, here referred to as a coating layer, is applied to the surface of the soleplate facing away from the housing of the iron. During ironing, this coating layer directly contacts the clothes (garment) being ironed. A prerequisite for the proper functioning of the iron is that such a coating layer meets a large number of requirements. For example, the coating layer must, inter alia, exhibit satisfactory low friction properties on the clothes to be ironed, it must be corrosion-resistant, scratch-resistant, and durable, and exhibit an optimum hardness and high resistance to wear and to fracture. The material of the coating layer must meet extra high requirements because the coating layer is exposed to substantial variations in temperatures ranging between 10° C. and 300° C., with typical operational temperatures ranging from 70° C. to 230° C. The required gliding behavior is obtained by having a low friction providing coating on the soleplate and this reduces the effective force applied on the garment as well.

Several materials may be used as low friction soleplate coating materials for an iron, such as silicates applied via sol-gel techniques, enamel, metal (e.g. nickel, chromium, stainless steel) that may be applied, for example, as sheet material or by thermal spraying, hard anodized aluminum, and diamond-like carbon coatings. Also an organic polymer may be used as a soleplate coating, for example polytetrafluoroethylene (PTFE). The PTFE low friction coating shows good gliding and non-stick properties, however the mechanical properties like scratch and wear resistance of PTFE coating is poor.

For interest in stain, scratch and wear resistant and consistent low friction elements of garment treatment appliances like on a garment dewrinkling device, such as an iron, or a steamer, it may be relevant that the coating maintains consistent good gliding behavior, as well as good stain, scratch and wear resistance under extreme usage conditions, e.g. cyclical temperature changes ranging from room temperature to 250° C., frequent mechanical wearing and high steam or humidity environments. Especially, the coating substantially maintains consistent good gliding behavior when used on all different types of garments, such as on cotton, linen, polyester, wool, and silk. The gliding behavior of soleplates provided with a coating known in the art may still vary when ironing different types of material. Especially, e.g., when a garment treatment appliance comprising coatings known in the art is applied on silk garment, the soleplate may stick to the silk garment due to static charging of the soleplate.

However, during ironing using known coating solutions, it appears that the friction between the coating and the garment may change, leading to unsatisfactory results in terms of ironing performances.

Document WO 2009/105945 discloses an electric iron including a soleplate and at least one heating element. The heating element includes a multi-layer conductive coating of nano-thickness disposed on the soleplate. The multi-layer conductive coating has a structure and composition which stabilize performance of the heating element at high temperatures.

Document US 2014/0120284 discloses a ceramic coating intended to be applied on a metal support and having the form of at least a continuous film having a thickness between 2 and 100 μm, this coating comprising a matrix including at least a metal polyalkoxide.

SUMMARY OF THE INVENTION

It is an aspect of the invention to provide an alternative treatment plate for a garment treatment appliance, which plate especially has a contact surface that in use slides on the garment being treated, which especially further at least partly obviates one or more of above-described drawbacks.

The invention is defined by the independent claims. The dependent claims define advantageous embodiments.

To this end, the invention provides a treatment plate for a garment treatment appliance, the treatment plate having a contact surface that in use slides on a garment being treated, the contact surface comprising a coating comprising a metal oxide coating, the metal oxide coating comprising (a) first metal ions selected from the group consisting of titanium, zirconium, hafnium, scandium, and yttrium and (b) second metal ions selected from the group consisting of cerium, manganese, and cobalt.

During ironing, the friction between the coating and the garment may change and, a build-up of static charge during ironing may negatively affect the friction between the coating and the garment. This improvement provided by the present invention may be explained by the mitigation of static charge while ironing, especially static charge that may be build up during sliding the treatment plate on the garment.

Coatings comprising additional late transition metal ions show a very good and even more consistent gliding behavior on all kinds of garment (material), especially also on silk garment.

Incorporating additional (late transition) metals in the gliding layer lowers the resistivity of the gliding layer. Especially introduced additional (late transition) metal oxides with varying redox potentials appear to be able to decrease the sheet resistance of (the coating comprising) the early transition metal oxides into the anti-static/dissipative range. Especially, (late transition) metal ions that have the ability to change their oxidation state quite easily and/or in multiple steps may be incorporated, especially metals that are easily oxidized and/or reduced by releasing or absorbing electrons. In that way the transport of charge along the surface of the layer may be improved, resulting in a lower resistivity.

Early transition metal oxide gliding layers for soleplates of (steam) irons may be modified with above mentioned metal oxides (of said second metal ions), especially to increase the electrical conductivity/decrease the resistance and therewith preventing soleplates (of (steam) irons) from static charging. Especially, by selecting the types and the ratio of first metal ions and second metal ions, a resistance of the metal oxide coating may be provided to be equal or lower than $1\cdot10^{11}$ Ω/square, especially equal or lower than $1\cdot10^{10}$ Ω/square. In embodiments, the resistance of the metal oxide coating may be provided to be equal or less than $1\cdot10^{9}$ Ω/square. Especially the resistance of the metal oxide coating is larger than $1\cdot10^{7}$ Ω/square, such as equal to or larger than $1\cdot10^{8}$ Ω/square.

Especially, the metal oxide coating of the invention has a sheet resistance equal to or lower than $1\cdot10^{10}$ Ω/square.

Traditionally, the conductivity of conducting oxides is described in terms of lattice defects/deficiencies in crystalline materials. In this case, especially the materials may be applied from solution starting from organically modified metal complexes that are cured at 300° C. giving materials that are most likely amorphous in structure.

The decrease of resistivity is not due to some crystal effect but due to the redox behavior of the metals that are added as there appears to be a clear relationship between redox potentials of the metals added and the resulting resistivity.

Especially, herein "first metal ion" or "first metal" may relate to an early transition metal, especially one or more of scandium, titanium, yttrium, zirconium, and hafnium. Herein, early transition metals especially refer to elements of groups 3-5, especially 3-4, and of periods 4-7, especially periods 4-6, of the periodic table.

Especially "second metal ion" or "second metal" may relate to one or more late transition metals, especially manganese, cobalt, and also cerium. Herein, late transition metals especially refer to elements of groups 7-9 and periods 4-6, especially periods 4-5 of the periodic table. Herein, cerium is for the sake of formulation indicated as late transition metal. Especially, second metal ion comprises (at least) cerium. The first metal (ion) and/or second metal (ion) may thus also (independently) refer to a plurality of different first metal(s) (ions) or a plurality of different second metal(s) (ions).

Herein, the phrase "treatment plate having a contact surface that in use slides on a garment being treated" and similar phrases are used.

The invention relates to the treatment plate per se; not only the treatment plate in use. Further, it is indicated that "said contact surface comprises a (e.g. sol-gel) coating that comprises a metal oxide comprising (a) first metal ions selected from the group consisting of titanium, zirconium, hafnium, scandium, and yttrium, and (b) second metal ions selected from the group consisting of cerium, manganese, and cobalt or an oxide mixture or mixed oxide thereof. Hence, during use of the (sol-gel) coating layer of the invention, that coating layer may thus in effect slide on the garment being treated. Further coatings may not be excluded, but those will in general not in use contact or slide on a garment being treated. For instance, a sole plate may include a (metal) substrate and a substrate coating on said (metal) substrate, on which substrate coating the herein described coating is applied. Hence, the term "contact surface" especially refers to an outer surface of the layer especially comprising the herein described coating, most remote from the substrate on which the coating is or coatings are provided (also see below). Especially, the treatment plate comprises the substrate and the coating according to the invention.

Additionally, the treatment plate may comprise one or more further (substrate) coatings or layers. Hence, especially the coating (of the invention) comprising metal oxides may in use slide on a garment being treated. Intermediate coatings between the substrate and the herein described oxide coating of at least two different metals may also be possible. The coating according to the invention may in embodiments especially (substantially) consists of an oxide mixture of the first metal and the second metal or a mixed oxide of the first metal and the second metal (including thus a mixed first metal/second metal-oxide, see below).

In embodiments the coating may consist of at least 50 wt. %, especially at least 75 wt. %, such as at least 85 wt. %, even more especially at least 90 wt. %, such as at least 95 wt. % $Me1_xMe2_yO$, wherein Me1 is one or more metal ions selected from the group of first metal ions (consisting of titanium, zirconium, hafnium, scandium, and yttrium), Me2 is one ore more metal ions selected from the group of second metal ions (consisting of cerium, manganese, and cobalt) and "x" and "y" are the amounts of the metal ions relative to oxygen (ions), with x and y being larger than 0. For instance, in $TiMnO_4$, x and y are both ¼. Especially, this does not exclude the presence of other metals in the mixture or the composition and/or the presence of other oxides. Herein, a formula like "$Me1_xMe2_yO$", may refer to mixed oxide but also to oxide mixtures. Here, x and y are larger than 0; x and y may be such that electro-neutrality is maintained in the oxide(s). The term "composition" may refer to a mixture of different oxides and/or to a mixed oxide (i.e. an oxide including different metal ions). Herein also a formula like "$Me1_aMe2_bO_z$" may be used, especially referring to $Me1_xMe2_yO$, wherein a, b, and z are larger than 0 and especially a, b, and z may be such that electro-neutrality is maintained in the oxide(s), and especially a=z*x and b=y*z.

In a further embodiment, the coating, i.e. the metal oxide coating, comprises a (mixed) metal oxide of first metal ions and second metal ions.

In yet another embodiment, the coating, i.e. the metal oxide coating, comprises a mixture of a metal oxide of first metal ions and a metal oxide of the second metal ions.

In a further embodiment, the coating, i.e. the metal oxide coating, essentially consists of a (mixed) metal oxide of first metal ions and second metal ions.

In yet another embodiment, the coating, i.e. the metal oxide coating, essentially consists of a mixture of a metal oxide of first metal ions and a metal oxide of the second metal ions.

Note that the term "metal oxide" may also refer to a plurality of (structurally) different metal oxides.

Even more especially, the first metal (ions) according to the invention are selected from the group consisting of titanium (ions), yttrium (ions), zirconium (ions), and hafnium (ions). In embodiments, the first metal ions are titanium ions and/or zirconium ions. In other embodiments, the first metal ions are (only) titanium ions. In embodiments, the first metal ions at least comprise zirconium ions. Especially, the first metal ions are zirconium ions.

Advantageously, the first metal ions are selected from the group consisting of titanium and zirconium.

Especially the resistivity of the coating may be reduced in coatings comprising (the oxides formed of) zirconium and/or titanium ions in combination with cerium and/or manganese ions.

Advantageously, the second metal ions are selected from the group consisting of cerium and manganese.

Hence, in embodiments the first metal ions are selected from the group consisting of titanium, zirconium, hafnium, scandium, and yttrium, especially titanium and zirconium, and the second metal ions are selected from the group consisting of cerium and manganese.

Advantageously, the second metal ions at least comprise cerium ions. Especially, the second metal ions are cerium ions. Hence, in embodiments, the metal oxide coating comprises zirconium-cerium-oxide. In other embodiments, the metal oxide (also) comprises titanium-cerium-oxide (or oxides comprising titanium/cerium oxide).

Especially, the coating of the invention comprises cerium ions. Specific mixed oxides or oxide compositions, of which one or more may be comprised by the coating, are one or more of $Ti_3Ce_2O_z$, $Ti_8CeO_z$, $Zr_3Ce_2O_z$, and $Zr_8CeO_z$. Especially, the coating comprises at least 85 wt. % of one or more of these metal oxides (relative to the total weight of the coating). Herein, formulas like "$Ti_3Ce_2O_z$, $Ti_8CeO_z$, $Zr_3Ce_2O_z$, and $Zr_8CeO_z$", may refer to mixed oxide but also to oxide compositions. Here, z is larger than 0; z may be such that electro-neutrality is maintained in the oxide(s).

Advantageously, the coating of the invention comprises manganese ions.

Specific mixed oxides or oxide compositions, of which one or more may be comprised by such coating are one or more of $Ti_3Mn_3O_z$, $Ti_8MnO_z$, $Zr_4Mn_3O_z$, and $Zr_8MnO_z$. Especially, in such embodiments said coating comprises at least 85 wt. % of one or more of these materials (relative to the total weight of the coating). Herein, formulas like "$Ti_3Mn_3O_z$, $Ti_8MnO_z$, $Zr_4Mn_3O_z$, and $Zr_8MnO_z$", may refer to mixed oxide but also to oxide compositions. Here, z is larger than 0; z may be such that electro-neutrality is maintained in the oxide(s).

It appears that present coatings have superior properties over coatings not comprising late transition metals, especially over coatings not comprising cerium, manganese, and cobalt, even more especially over coatings not comprising cerium and/or manganese.

Advantageously, in embodiments, the metal oxide coating has a layer thickness selected from the range of 50 nanometers (nm)-5 micrometers (μm).

The advantages of the metal oxide coatings, used in the invention, are that they show a low coefficient of friction, show minimized static charge built-up during rubbing/ironing, have especially a thickness of less than 1 μm, and can be applied with a low temperature process (especially at temperatures below 400° C.), such as a sol-gel process to obtain a sol-gel coating. They are further transparent at a more preferred thickness of less than 400 nm. Especially, the metal oxide coating has a thickness ranging from 50 nm-1 μm, especially 50 nanometers to 400 nanometers. Especially, the reduced triboelectric effect during rubbing/ironing is assumed to be the result of the introduction of the late transition metals, especially decreasing the resistivity of the coating. Additionally, the early transition metals in the coating especially allows a kind of building up of a layer of lubricating organic particles/contaminants (debris) on the coating (also) promoting a reduced static charge build-up. Especially, the presence of the late transition metals (i.e. the second metal ions) and of the early transition metals (i.e. first metal ions) have a synergistic effect.

The absolute effect of changing the molar ratio of the first metal ions to the second metal ions may depend on the late transition metal ions and the early transition metal ions.

Advantageously, in embodiments the metal oxide coating comprises a ratio of second metal ions to first metal ions of at least 0.075, especially at least 0.15.

Advantageously, in further embodiments, the metal oxide coating comprises a ratio of second metal ions to first metal ions of at maximum 2.

Advantageously, the metal oxide coating has a sheet resistance equal to or lower than $1 \cdot 10^{10}$ Ω/square.

The invention further relates to a treatment plate which is a soleplate for an ironing appliance, to an ironing appliance comprising a treatment plate as a soleplate as disclosed above, and to a garment treatment appliance comprising a treatment plate as disclosed above.

It has been found that even at low temperatures the gliding behavior of the coated treatment plate according to the present invention is excellent, thus allowing low temperature ironing.

Hence, in a further aspect, the invention also provides a garment treatment appliance comprising a treatment plate as described herein, wherein the garment treatment appliance is especially selected from the group of appliances consisting of an iron, a steam iron, and a steamer.

In a further aspect, the invention relates to a method of providing a treatment plate for treating garments. The treatment plate has a contact surface that in use slides, on a garment being treated. The method comprising the step of providing on at least part of the contact surface a metal oxide coating, wherein the metal oxide coating comprises (a) first metal ions selected from the group consisting of titanium (Ti), zirconium (Zr), hafnium (Hf), scandium (Sc), and yttrium (Y); and (b) second metal ions selected from the group consisting of cerium (Ce), manganese (Mn) and cobalt (Co).

In embodiments, the present method comprises the steps of depositing on the contact surface a layer of a hydrolysable precursor, especially an alkoxide precursor or an acetate precursor, of a first metal selected from the group consisting of titanium, zirconium, hafnium, scandium, and yttrium and a second metal selected from the group consisting of cerium, manganese and cobalt, especially at least comprising titanium and/or zirconium and cerium and/manganese, and curing said layer to obtain said metal oxide coating.

In embodiments, the method comprises providing a precursor of the metal oxide coating to said contact surface to provide a deposition on said surface and curing the deposition to provide said metal oxide coating.

BRIEF DESCRIPTION OF THE DRAWINGS

Embodiments of the invention will now be described, by way of example only, with reference to the accompanying schematic drawings in which corresponding reference symbols indicate corresponding parts, and in which.

The schematic drawings are not necessarily on scale.

DETAILED DESCRIPTION OF THE EMBODIMENTS

Figure 1:
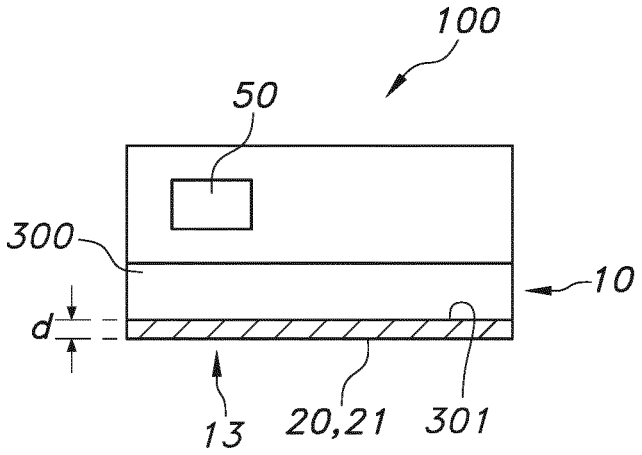
FIG. 1 schematically depicts an embodiment of a garment treatment appliance according to the invention, comprising a treatment plate according to the invention; the drawing is also intended to depict the treatment plate as such.
Figure 3:
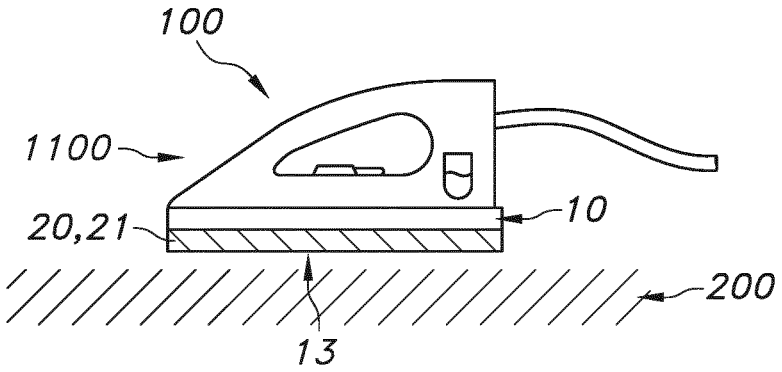
FIG. 3 schematically depicts an other embodiment of a garment treatment appliance according to the invention.

FIGS. 1 and 3 schematically depict two embodiments of a garment treatment appliance 100. The embodiments comprise a treatment plate 10 for the garment treatment appliance 100. These figures are also used to display the treatment plate 10 per se. The treatment plate 10 has a contact surface 13 that in use slides on a garment 200 being treated. This contact surface 13 comprises a coating 20 comprising a metal oxide coating 21. Hence, especially in use, the coating 20 slides on a garment 200 being treated. Reference 300 indicates a substrate, such as a metal plate, with a surface 301, on which the coating may be provided. In embodiments, the coating 20 is a sol-gel coating 20. Especially, the metal oxide coatings of the invention may require a thickness less than 10 μm, like equal or less than 5 μm, such as equal or less than 1 μm, like equal or less than 400 nm, or even equal or less than 100 nm to provide the desired gliding properties. In embodiments, the thickness of the metal oxide coating is at least 10 nm, especially at least 50 nm. Especially, the thickness d of the coating 20 is selected from the range of 50 nm 5 μm. Especially, this metal oxide coating 21 is configured for its excellent gliding properties and in embodiments has a sheet resistance equal to or lower than $1 \cdot 10^{10}$ Ω/square. The metal oxide coating 21 comprises first metal ions selected from the group (of early transition metals) consisting of titanium, zirconium, hafnium, scandium, and yttrium, especially titanium, zirconium, hafnium, and yttrium, and second metal ions selected from the group of (late transition metals) consisting of cerium, manganese, and cobalt. The first metal ions may especially be selected from titanium and zirconium and especially the second metal ions may be selected from cerium and manganese. In embodiments the first metal ions are zirconium ions. In further embodiments, the second metal ions are cerium ions. Especially, the metal oxide coating 21 comprises a ratio of second metal ions to first metal ions of at least 0.075, such as at least 0.15, and especially of at maximum 2.

The garment treatment appliance 100 may comprise extra support and control systems, such as a heater 50, schematically depicted in FIG. 1. The skilled person will understand that the garment treatment appliance 100 according to the invention may also comprise other support and control systems (not shown in the figures), such as a steam provision, temperature sensing devices and a steam and/or temperature controlling device.

In the embodiments depicted in FIGS. 1 and 3, the coating 20 only shows a mono-layer coating 20. However, in other embodiments the coating 20 may also comprise a multi-layer coating comprising one or more layers, especially selected from the group consisting of a metal layer, an enamel, an organic polymer comprising layer, an organo silicate comprising layer, a silicate comprising layer, and comprising said metal oxide coating 21 as outer layer. Especially the (surface 301) of the substrate 300 may comprise one or more (intermediate) layers as discussed above and the coating 20 is provided on the one and more (intermediate) layers. Especially the coating 20 is arranged most remote from the surface 301 of the substrate 300, enabling it to slide on garment 200 when the treatment plate 10 is in use (treating the garment 200).

Especially the metal oxide coating 21 may be a sol-gel metal oxide coating 21. Moreover, in multi-layer coatings 20 also one or more of the other coating layers may comprise a sol-gel layer.

In embodiments, the garment treatment appliance 100 comprises an iron 1100, see FIG. 3. In Further embodiments the garment treatment appliance 100 comprises a steam iron. In other embodiments, the garment treatment appliance 100 comprises a steamer. However, the invention is not limited to these three embodiments.

Figure 2:
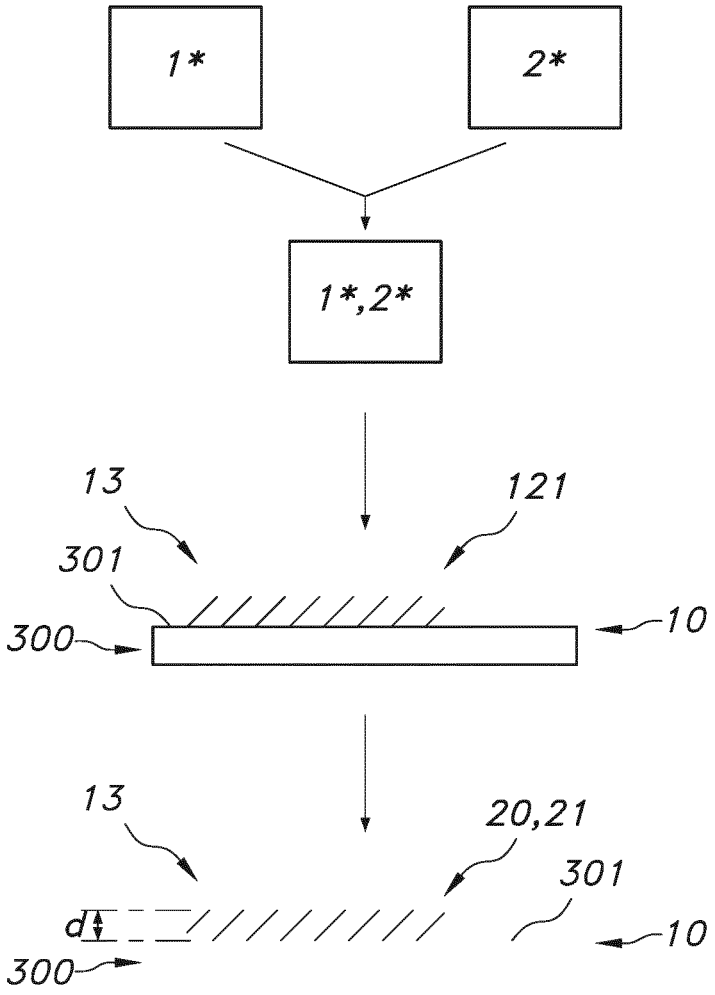
FIG. 2 schematically depicts an embodiment of the method of coating a treatment plate.

FIG. 2 schematically depicts an embodiment of a method providing a treatment plate 10 for a garment treatment appliance 100. Herein a metal oxide coating 21 is provided on at least part of the surface 301 of the substrate 300, especially configured from a precursor 1* comprising first metal ions, selected from titanium, zirconium, hafnium, scandium, and yttrium, and second precursor 2* comprising second metal ions are selected from the group consisting of cerium, manganese and cobalt.

In the embodiment of FIG. 2, a sol-gel process is depicted: a solution of precursors, such as metal-acetate or metal-alkoxide precursors, are prepared (top) and mixed (middle): 1*,2*. The mixture is deposited at the surface 301 of the substrate 300 providing the deposition 121. After drying and/or curing, the deposition 121 may provide said metal oxide coating 21, especially having a thickness d.

The solvent used for the preparation of the precursor solution may especially be a lower alcohol. Drying and curing of the deposited layer of an alkoxide precursor of a metal is especially effected at a temperature below 400° C. This layer can directly be deposited on the surface 301 of substrate 300, providing the treatment plate 10. Hereby, the treatment plate has a contact surface 13 that in use slides on a garment (not depicted) being treated.

Especially, the thus obtained layer is comprised by the coating as outer layer or gliding layer, which in use slides on a garment being treated. Especially, the first metal (ions) is (are) selected from the group consisting of titanium, yttrium, zirconium, and hafnium (ions).

Especially, (the surface of) the substrate may additionally comprise one or more (additional) layers or coatings, wherein the metal oxide coating is provided on top of the one or more additional layers. Especially, the metal oxide coating provided is most remote from the substrate (enabling the metal oxide coating to slide on the garment when the treatment plate is in use during treating a garment).

Hence, the layer thus obtained may comprise a mixed oxide, in specific embodiments comprising titanium oxide and cerium oxide; other oxides and/or mixed oxides may optionally also be included. Especially, the layer thus obtained comprises (mixed) metal oxides comprising first metal ions selected from the group consisting of titanium, zirconium, hafnium, scandium and yttrium, especially titanium, zirconium, hafnium, and yttrium, even more especially titanium and/or zirconium, and second metal ions selected from the group consisting of cerium, manganese and cobalt, especially at least one metal oxide selected from the group consisting of zirconium-cerium oxide, titanium-cerium oxide, zirconium-manganese oxide, and titanium-manganese oxide. Further, especially, the layer or metal (oxide) coating comprises at least 50 wt. %, even more especially at least 75 wt. %, yet even more especially at least 90 wt. %, relative to the layer or coating, respectively, of the herein indicated (mixed) metal oxide(s).

With this method, a treatment plate for a garment treatment appliance for treating garments may be provided, which treatment plate has a contact surface that in use slides on the garment being treated, and wherein said contact surface comprises a coating wherein the coating comprises first metal ions selected from the group consisting of titanium, zirconium, hafnium, scandium, and yttrium; and second metal ions selected from the group consisting of cerium, manganese and cobalt, especially wherein the coating comprises a mixed oxide comprising one or more of zirconium-cerium oxide, titanium-cerium oxide, zirconium-manganese oxide, and titanium-manganese. During use, said coating, such as described herein, will slide on the garment being treated. The coating may herein therefor also be indicated as "garment treatment coating" or "gliding layer".

Such a method may comprise the deposition of the precursor compound by means of a dry chemical process, especially a vapor deposition process.

In further embodiments, the present method comprises the steps of preparing a hydrolysable precursor solution, especially of an alkoxide precursor or an acetate precursor, of a first metal selected from the group consisting of titanium, zirconium, hafnium, scandium, and yttrium and a second metal selected from the group consisting of cerium, manganese and cobalt, especially at least comprising titanium and/or zirconium and cerium and/manganese, depositing a layer of said precursor solution on said (surface of the) substrate), followed by drying, if necessary, and curing to obtain the layer. Different precursors for different metals may be applied.

In such a method, the deposition may be effected by means of a wet chemical process, especially a solution process, more especially a sol-gel process. The metal alkoxide or acetate precursors, especially used in the invention, are (iso-)propanolate or acetylacetonate derivatives thereof (i.e. a (iso-)propanolate or acetylacetonate derivative of the alkoxide or acetate). Diketones like e.g. acetyl acetone or ethyl acetoacetate can be used to make the precursors less water sensitive. The invention is nevertheless not restricted to these precursors; other alkanolates can be used as well, also other metal salts can be used like e.g. acetates provided that they can easily be converted into the oxide form in the present process. Alkoxides may e.g. be modified by alkoxy- and aminoalcohols, β-diketones, β-ketoesters, carboxylic acids to provide metal alkoxide or metal alkoxide derivatives. Examples of suitable alkoxides and acetates are isopropopoxide, (iso) propanolate, acetate, acetylacetonate, ethylacetoacetate, t-butylacetoacetate, etc.

The solvent used for the preparation of the precursor solution may especially be (an aqueous solution of) a lower alcohol, specifically ethanol, isopropyl alcohol, 2-butanol or 2-butoxy ethanol. In other embodiments, the solvent for the preparation of the precursor solution, especially is water. Drying and curing of the deposited layer of an alkoxide precursor of a metal is especially effected at a temperature below 400° C. This layer can directly be deposited on the (surface) of the substrate, especially of the treatment plate.

In embodiments, said contact surface of the substrate consists of a metal, enamel, organic polymer, organo-silicate, or silicate composition. In embodiments of the invention, said surface has been precoated with at least one layer, especially consisting of a metal composition, an enamel, an organic polymeric, organo-silicate or silicate coating, more especially a metal oxide layer, made for example by a sol-gel technique. The precoated layer, i.e. the intermediate layer, may especially provide the mechanical strength and is in general at least 1 μm thick, such as in the range of 1-100 μm. The metal oxide coating of the invention especially provides the low friction function, and has a thickness especially of not larger than 1 μm, such as 50-400 nm. As indicated above, the intermediate layer may especially be provided by a sol-gel process. In case of an iron, the metal oxide (overcoat) layer can thus be deposited on top of a sole-plate coating, which may especially be a silicate based coating, applied by a sol-gel process or by another process like PVD, CVD and thermal spraying, thus further improving the gliding behavior of the sol-gel based silicate coating. These processes are well-known to an expert. The sol-gel coating with the external metal oxide layer then shows excellent and consistent gliding behavior, while it maintains good wear, scratch, and strain resistance.

Especially, a sol-gel process for oxide layer formation may be selected for its low cost, and it is easy for industrialization. As indicated above, an advantage of sol-gel layer is its ease for industrialization via e.g. a simple spraying process instead of vacuum process. It is further beneficial that for the present coating, such as e.g. obtainable by spray-painting the metal oxide layer, such as especially a cerium comprising layer, the final layer may not need post polishing, as is needed with e.g. plasma sprayed layers. Furthermore, the coating (or gliding layer) of the invention especially is transparent and not opaque as particle based coatings from the prior art. It may therefore not influence how the color of the coating is perceived. For instance, when a colored base layer is applied, or when a print is available, this may still be seen through the coating. Hereby, more design freedom is retained than in some prior art solutions where the color is e.g. the intrinsic color of the plasma sprayed layer.

Herein, the term "sol-gel (coating) process" and similar terms refer to the herein described sol-gel process.

An intermediate layer, located between a metal support (especially substrate) of the iron and the external layer, can contain e.g. a mixture of fine metal oxide fillers and a sol such as silica sol and silanes, e.g. organically modified silanes, providing good adherence to the metal substrate as well as good mechanical properties, on which a metal oxide (external) layer is disposed, such as comprising in embodiments at least an oxide of (a) titanium and/or zirconium, and (b) cerium and/or manganese or combinations thereof, with the oxide being one or more of a mixed oxide and a mixture of oxide.

The coating can thus be applied by a solution deposition process, such as spincoating, dip-coating or spraying process, or by a vapor deposition process, like PVD or CVD, or by a thermal spray process. Especially, the coating of the invention is applied by a solution deposition process, such as spin-coating, dip-coating or spraying process. More especially, the deposition process comprises a sol-gel process.

Hence, the invention also provides a method for providing a treatment plate comprising a sol-gel coating for a garment treatment appliance, wherein the treatment plate comprises a substrate comprising a (substrate) surface, and optionally thereon an intermediate layer, wherein the method comprises providing said sol-gel coating on the surface of the substrate (optionally comprising the optional intermediate layer), wherein this method comprises a sol-gel coating process, and wherein the sol-gel coating on the substrate (optionally comprising the intermediate layer) comprises a (mixed) metal oxide comprising first metal ions selected from the group consisting of titanium, zirconium, hafnium, scandium, and yttrium, especially titanium and zirconium; and second metal ions selected from the group consisting of cerium, manganese and cobalt, especially cerium and manganese, even more especially the second metal ions are cerium ions. In embodiments, the second metal ions comprise manganese ions, especially the second metal ions are manganese ions.

The invention also relates to a method to improve the gliding behavior of a treatment plate for a garment treatment appliance, especially a soleplate for an ironing appliance, by applying on a surface of said substrate a coating that comprises a metal oxide comprising first metal ions selected from the group consisting of titanium, zirconium, hafnium, scandium, and yttrium, especially titanium and zirconium; and second metal ions selected from the group consisting of cerium, manganese and cobalt, especially cerium manganese, even more especially the second metal ions are cerium ions.

Further, the specific embodiments described above with respect to a treatment plate comprising the coating, especially for a garment treatment appliance, may also apply to, and may be combined with, the herein described method and method embodiments.

The main element of the present invention is thus a thin layer of metal oxide film that can be applied on top of a substrate by a sol-gel process, or by PVD, CVD or thermal spray process, especially by a sol-gel process, to improve the coating gliding performance on garment. Hence, the main element of the present invention is thus a thin layer of metal oxide film that can be applied on top of a substrate optionally already including a pre-coat (or in fact an intermediate layer) by a sol-gel process, or by PVD, CVD or thermal spray process, especially by a sol-gel process, to improve the coating gliding performance on garment. This new low friction, anti-static, anti-scratch, anti-wear, and easy-clean coating with metal oxide layer offers many advantages over conventional coatings because of their excellent and consistent gliding behavior, especially on all types of garments, as well as stain, scratch and wear resistant properties.

Especially, a treatment plate is provided with a stack of layers, with a base layer and the gliding layer or coating as described herein. The base layer is directed to the treatment plate, and may even be in contact with the treatment plate. Especially, the gliding layer or coating in use slides on a garment being treated. In between the base layer and the gliding layer or coating, there may be optionally further layers. Optionally, a print may be available between the base layer and the coating layer or gliding layer. Especially, most of the layers of the stack are sol-gel coatings. For instance, the print may be a silicone based material. Hence, in an embodiment all layers, except for the optional print may be sol-gel layers.

Figure 4:
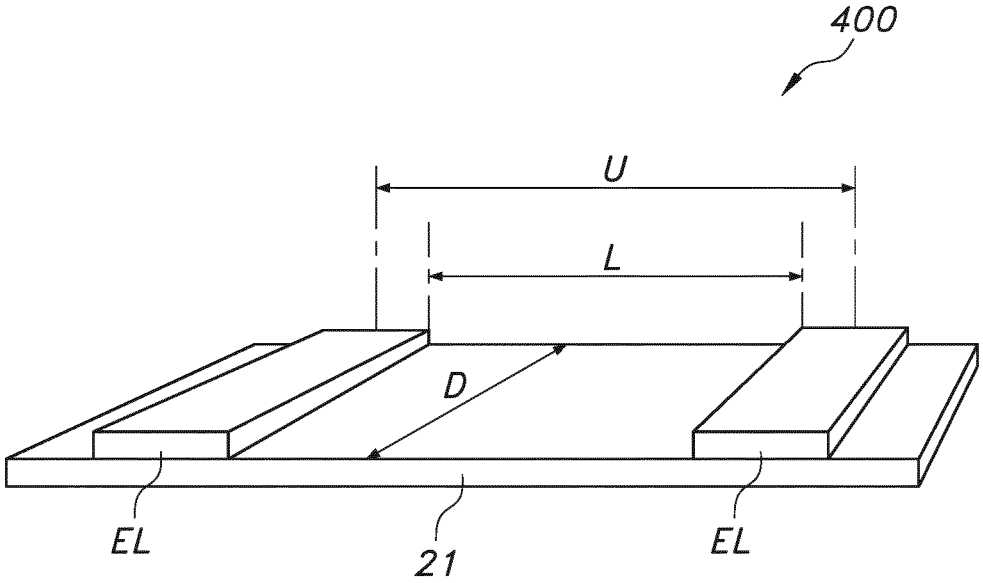
FIG. 4 schematically depicts elements of a measuring system to determine the resistivity.

FIG. 4 schematically depicts a measuring element 400 of a measuring system that is used to determine the (sheet) resistivity of the metal oxide coating 21. "(Sheet) resistivity" is also described herein as "resistance" and "sheet resistance". Sheet resistance is a material property and is applicable to two-dimensional systems in which thin films and coatings are considered as two-dimensional entities. In regular three dimensional systems, the volumetric resistance (defined in Ω) is typically defined as being the ratio of the voltage (in Volt) over the three dimensional body and the current (in Ampere) through the body ($R_{vol}$=U/I). Sheet resistance R or $R_s$ of the metal oxide coating 21 is determined by measuring the voltage U and the current I between two electrodes EL over an area having a width D and a length L. The sheet resistance is defined by R=(U/I)/(L/D). As both the volumetric resistance $R_{vol}$ and the sheet resistance (or resistivity) have the physical unit Ohm (Ω), the sheet resistance is normally expressed as Ω/square. Other common ways to express the sheet resistance are e.g. Ω□, Ω□, and Ω/sq.

Static charging is a known phenomenon to occur when two dissimilar materials are rubbed against each other. The sensitivity of materials to this effect is visualized into what is called the triboelectric series of which a typical table is shown below:

| Example Materials in the Triboelectric Series | |
|---|---|
| + | Glass |
| Positive | Mica |
| | Human Hair |
| | Wool |
| | Fur |
| | Lead |
| | Silk |
| | Aluminum |
| | Paper |
| | Cotton |
| | Steel |
| | Wood |
| | Amber |
| | Sealing Wax |
| | Nickel, Copper |
| | Brass, Silver |
| | Gold, Platinum |
| | Sulfur |
| | Acetate Rayon |
| | Polyester |
| | Celluloid |
| negative | Silicon |
| − | Teflon |

Static charge build up during ironing may thus vary considerably between different types of garment. The build up further especially may depend on the (surface) conductivity of the treatment plate. The build up may be high for insulating materials, whereas the build up may be low for anti-static, dissipative or conductive materials, wherein the charge may mitigate while ironing.

Typical $TiO_2$, $ZrO_2$, $HfO_2$, $Sc_2O_3$, and $Y_2O_3$ layers comprising only said first metal ions especially show a high resistivity (sheet resistance) of $10^{11}$ Ω/square or higher (see further below), making them sensitive to the triboelectric effect during ironing.

Filling the layers with conductive particles might be an option to lower resistivity but this has the drawback that extremely small particles are needed to incorporate into the layers that may be less than 100 nm thick. Dispersability, homogeneity and availability (cost) of these extremely small particles is far from trivial. Moreover, conductivity in that case, especially, is achieved by percolation requiring that the particles physically are in close vicinity. A high filling degree is needed therefore with all problems associated with that with respect to lacquer preparation and spraying. Hence, this does not appear to be a solution.

Alternatively, electrically conducting metal oxides are known and especially when they are transparent, widely used in displays. Indium doped Tin oxide (ITO) and Antimony doped Tin oxide (ATO) are well known examples of these. These oxides are normally applied by vapor deposition. However, besides material cost considerations, this deposition technique is less suited for a soleplate. Furthermore their affinity to organic material might not be as high as the early transition metal oxides as described above. Hence, this does not appear to be a solution either.

Herein the term "resistivity" is used. Especially this term refers to the "sheet resistivity" or "sheet resistance" R (or $R_s$) and may be defined in the unit Ω/square ("Ω/sq" or "Ω/□"),) (see also below). The (surface) conductivity of a material determines whether it is considered to be insulating, anti-static, dissipative or electrically conducting. A commonly used distinction based on resistivity is: insulating: $R>10^{12}$ Ω/square; anti-static: R is in the range $10^{12}$-$10^{9}$ Ω/square; dissipative: R is in the range $10^{9}$-$10^{6}$ Ω/square; (semi) conductive: $R<10^{6}$ Ω/square.

EXPERIMENTAL

Redox potentials are illustrative for the tendency of an ion or solid to be reduced/oxidized.

For example $Na^+$ ion has a potential of −2.71V showing that its reduction is very difficult or phrased in another way, has a very low tendency to pick up electrons from ambient. Likewise $Zr^{IV}/Zr^0$ has a potential of −1.45V which is also very high showing the inability of $ZrO_2$ (with $Zr^{IV}$ ions) to pick up electrons under ambient conditions.

For Ti a $Ti^{III}/Ti^{II}$ couple is given of −0.37V in literature but oxides stabile in ambient are based on $Ti^{IV}$ with a potential likely close to $Zr^{IV}$. Likewise the $Y^{III}/Y$ couple of −2.38V also indicates no tendency to absorb any charge. Checking resistivity of Y modified Zirconium oxide layers confirms this by a measured resistivity values of $10^{11}$ Ω/square. The same holds for La with its potential of −2.38V.

More interesting from redox potential point of view are transition metals that can exhibit several oxidation states and/or have a more positive redox potential. For testing a selection was made, comprising:

Cerium with the $Ce^{IV}/Ce^{III}$ redox couple at +1.72V.

Manganese with the $Mn^{III}/Mn^{II}$ redox couple at +1.56V.

Vanadium with the $V^{III}/V^{II}$ redox couple at −0.25V but with potentials going up to +0.34 for the $V^{IV}/V^{III}$ couple and +1.0V for the $V^{V}/V^{IV}$ couple, both under more acidic conditions.

Niobium with the $Nb^{V}/Nb^{IV}$ redox couple at −0.25V (under acidic conditions).

Cobalt with the $Co^{III}/Co^{II}$ redox couple at +1.81V and $Co^{II}/Co^0$ redox couple at −0.28V Iron with the $Fe^{III}/Fe^{II}$ redox couple at +0.77V Chromium with the $Cr^{III}/Cr^{II}$ redox couple of −0.42V Not all oxidation states of the metals mentioned above have equal stability. The chemical environment (e.g. pH) plays an important role in that. But one can expect that the metals that are mentioned should in principle respond easier to charge variation than metals that have only 1 redox potential at a very high (negative) value.

Resistivity/Sheet Resistance

The metal oxide layers were made as stand-alone and also combined with Ti and Zr and applied by spraying on a glass slide followed by curing at 300 C and measuring the resistivity, also herein referred to as sheet resistance. The results are shown in the table below. In this table the measured resistivity of the layer on glass is given in the column "resistivity". In the last column the redox couple described in the literature for the single metal (ion) under neutral conditions is given.

| | Resistivity (Ω/square) | Redox potential (V) |
|---|---|---|
| $ZrO_2$ | $>1 \cdot 10^{12}$ | −1.45 V |
| $TiO_2$ | $3 \cdot 10^{11}$ | −0.37 V |
| $La_2O_3$ | $5 \cdot 10^{11}$ | −2.52 V |
| $La_2Ti_3O_x$ | $1 \cdot 10^{12}$ | |
| $Nb_xO_y$ | $5 \cdot 10^{11}$ | −0.25 V (acidic conditions) |
| $Ti_3Nb_2Ox$ | $3 \cdot 10^{11}$ | |
| $Ce_xO_y$ | $2 \cdot 10^{9}$ | +1.72 V |
| $Ti_3Ce_2O_x$ | $2 \cdot 10^{8}$ | |
| $Ti_8CeO_x$ | $2 \cdot 10^{8}$ | |
| $Zr_3Ce_2O_x$ | $5 \cdot 10^{8}$ | |
| $Zr_8CeO_x$ | $4 \cdot 10^{8}$ | |
| $Cr_2O_3$ | $4.0 \cdot 10^{9}$ | −0.42 V |
| $Ti_8CrO_x$ | $1.0 \cdot 10^{9}$ | |

-continued

| | Resistivity (Ω/square) | Redox potential (V) |
|---|---|---|
| $V_xO_y$ | $3 \cdot 10^{8}$ | −0.25 V |
| $Ti_4V_3O_x$ | $5 \cdot 10^{9}$ | |
| $Ti_8VO_x$ | $3 \cdot 10^{9}$ | |
| $Zr_4V_3O_x$ | $5.0 \cdot 10^{10}$ | |
| $Fe_2O_3$ | $4.0 \cdot 10^{9}$ | +0.77 V |
| $Ti_8FeO_x$ | $5.0 \cdot 10^{9}$ | |
| $Mn_xO_y$ | $2.5 \cdot 10^{8}$ | +1.56 V |
| $Ti_4Mn_3O_x$ | $1.5 \cdot 10^{8}$ | |
| $Ti_8MnO_x$ | $1.0 \cdot 10^{8}$ | |
| $Zr_4Mn_3O_x$ | $4.0 \cdot 10^{8}$ | |
| $Zr_8MnO_x$ | $6.0 \cdot 10^{8}$ | |
| $CoO_x$ (based on $Co(AcAc^*)_2$ | $1.3 \cdot 10^{8}$ | −0.28 V |
| $Ti_8VO_x$ | $8 \cdot 10^{9}$ | |
| $CoO_x$ (based on $Co(AcAc^*)_3$ | $1 \cdot 10^{10}$ | +1.81 V |
| $Ti_8VO_x$ | $1 \cdot 10^{10}$ | |

*AcAc is the abbreviation of acetylacetone (see below)

Conclusion and Discussion

Zr oxide and Ti oxide have high resistivity.

La oxide with its very high redox potential also shows a very high resistivity.

Nb, although having various possible oxidation states is not able to lower the resistivity significantly. Its redox potential is −0.25 but under acidic conditions which is not the case in the oxide layer made. Thus its high resistivity therefore is not a surprise.

Ce with only 1 intermediate oxidation state ($Ce^{III}$) but with high positive redox potential brings the resistivity down significantly. The effect remains in combination with Ti and Zr oxide.

V has more possible oxidation states but has a quite low redox potential. It shows in pure form low resistivity but loses quickly its effect when mixed with Ti or Zr.

Iron has quite high redox potential but not to the level of Ce and cannot match the lowering effect of the Ce on resistivity.

Manganese exhibits various oxidation states and its high potential value is very efficient to lower the resistivity in combination with titanium and zirconium oxide.

Layers based on pure $Co^{II}(AcAc)_2$ show low resistivity. Mixed with Ti or Zr it loses its effect somewhat. $Co^{III}$ shows a high resistivity. It is theorized that the $Co^{III}(AcAc)_3$ complex decomposed to other lower oxidation states upon the heating of the layer, increasing the resistivity to higher levels then was to be expected from the initial high redox potential.

Although the resistivity can be tuned as can be derived from the table, the overall gliding should not suffer.

Going from the early to the late transition metals, the overall gliding becomes less. While V as pure oxide still shows decent gliding, e.g. Manganese and Cobalt oxide are very poor in gliding on cotton. Combining Zr or Ti with Mn gives very good gliding. In the case of Cobalt its negative effect on gliding becomes that prominent that also a combination with Ti or Zr is not able to improve on that (when compared with same metal ratios).

In a typical comparative experiment where Ti and Zr were mixed with V or Mn or Co in a ratio of 4/3 the Ti/V, Zr/V and Ti/Mn, Zr/Mn were good in gliding but the Ti/Co and Zr/Co combinations were relative draggy.

Thus it is clear from the table that lowest resistivity is obtained with Ce and Mn both having also the highest redox potential. This supports the idea that addition of metal ions with (stable) high redox potentials is able to lower the resistivity of early transition metal oxide based gliding layers.

To verify the effectiveness of both metals another test was performed with lowering the amount of Ce/Mn in Titanium and Zirconium oxide layers.

| Metal ratio | resistivity (Ohm/square) | Metal ratio | resistivity (Ohm/square) |
|---|---|---|---|
| Ti/Ce (3/2) | 2 $10^8$ | Ti/Mn (4/3) | 2.0 $10^8$ |
| Ti/Ce (6/1) | 2 $10^8$ | Ti/Mn (4/2) | 1.5 $10^8$ |
| Ti/Ce (12/1) | 2 $10^8$ | Ti/Mn (4/1) | 1.0 $10^8$ |
| Ti/Ce (16/1) | 2 $10^8$ | Ti/Mn (8/1) | 1.0 $10^8$ |
| Ti/Ce (32/1) | 2 $10^8$ | Ti/Mn (16/1) | 7.0 $10^8$ |
| Ti/Ce (64/1) | 1 $10^8$ | Ti/Mn (32/1) | 3.0 $10^8$ |
| Ti/Ce (128/1) | 1 $10^9$ | Ti/Mn (64/1) | 2.0 $10^8$ |
| | | Ti/Mn (128/1) | 3.0 $10^9$ |
| Zr/Ce (3/2) | 5 $10^8$ | Zr/Mn (4/3) | 8.0 $10^8$ |
| Zr/Ce (6/1) | 4 $10^8$ | Zr/Mn (4/2) | 1.7 $10^8$ |
| Zr/Ce (12/1) | 4 $10^8$ | Zr/Mn (4/1) | 3.0 $10^8$ |
| Zr/Ce (16/1) | 1 $10^9$ | Zr/Mn (8/1) | 6.0 $10^8$ |
| Zr/Ce (32/1) | 3 $10^9$ | Zr/Mn (16/1) | 1.0 $10^9$ |
| Zr/Ce (64/1) | 1 $10^9$ | Zr/Mn (32/1) | 2.0 $10^9$ |
| Zr/Ce (128/1) | 5 $10^{10}$ | Zr/Mn (64/1) | 4.0 $10^9$ |
| | | Zr/Mn (128/1) | 2.0 $10^{11}$ |

Quite low amounts of Ce and Mn are needed to bring the resistivity of Ti and Zr oxide layers down into the anti-static/dissipative range.

Overall the combination with Titanium is showing lower resistivity than combined with Zr which arises from the fact that Titanium by itself already has lower resistivity compared to Zr.

Experimental Details

Titanium i-propoxide and Zirconium propoxide (70% in propanol) were reacted with 2 equivalent acetylacetone (AcAc) forming respectively $TiAcAc_2$ and $ZrAcAc_2$. The resulting solutions were used without further purification. The mono AcAc complexes were made by reacting the alkoxides with 1 eq AcAc.

1 gr of TiAcAc was dissolved in 25 gr BuOH. After spraying and curing at 300 C the resistivity was measured to be 3 $10^{11}$ Ohm/square.

1 gr ZrAcAc was diluted with 25 gr BuOH. After application the resistivity was measured to be ~$10^{12}$ Ohm/square Combinations with Other Metals:

$La_2Ti_3O_5$: 0.5 gr $LaAc_3$ was reacted with 0.32 gr AcAc (2 eq) and 0.22 gr $NH_3$ (25%)(2 eq) in 25 ml DMF. After a clear solution was obtained 0.91 gr of the $TiAcAc_2$ was added. The mixture was sprayed onto a glass slide and cured at 300 C. The resistance was shown to be ~$10^{12}$ Ohm/square. The gliding was good. The native $LaAcAc_2$ solution showed similar resistivity after spraying and curing.

$Ti_4(VO_4)_3$: 0.5 gr $VO(OPr)_3$ was mixed with 0.27EAA (1 eq) followed by mixing with 1.06 gr TiAcAc and diluting with 25 gr BuOH. Curing at 300 C after spraying on glass slide showed a resistivity of 2 $10^{10}$ Ohm/square. The gliding was good.

$Ti_4CO_3O_x$: 0.5 gr TiAcAc was mixed with 0.25 gr $Co(AcAc)_2$ (Aldrich) in 25 gr ethyleneglycol butyl ether. After spraying and curing a resistivity was measured of 3 $10^9$ Ohm/square. The gliding however was quite poor. The native $CoAcAc_2$ showed a resistivity of 1.3 $10^8$ Ohm/square.

$Ti_xMn_yO_z$: Different ratios of Ti or Zr and Mn were made by dissolving $TiAcAc_2$ or $ZrAcAc_2$ in water/alcohol followed by adding $MnAc_2$ (Manganese Acetate). For example: 1.32 gr $TiAcAc_2$ was added to a mixture of 18 gr water and 6 gr ethanol and 0.33 gr $MnAc_2$ was added giving a Ti/Mn ratio of 2/1. After spraying and curing a resistivity was measured of 1.5 $10^8$ Ohm/square.

$Zr_xCe_yO_z$: Different ratios of Ti or Zr with Ce were made by dissolving $TiAcAc_2$ or $ZrAcAc_2$ in water/alcohol followed by adding $CeAc_3$ (Cerium acetate). For example: 1.58 $ZrAcAc_2$ was mixed with 0.125 gr $CeAc_3$ in 18 water and 6 gr ethanol. The layer after spraying and curing showed resistivity of 4 $10^8$ Ohm/square. (Zr/Ce=6/1). $Ti_4Fe_3O_x$: 1.32 gr $TiAcAc_2$ was mixed with 0.72$Fe(AcAc)_3$ in 24 gr ethyleneglycol butylether. After application resistivity was 5 $10^8$ Ohm/square while the $FeAcAc_3$ as such resulted in a resistivity of 4 $10^9$ Ohm/square after spraying and curing. The gliding was poor.

$Ti_xNb_yO_z$: 0.5 gr $TiAcAc_2$ was mixed with 0.21 ammonium Niobate oxalate hydrate in a mixture of 21 gr water and 3 gr ethanol. (Ti/Nb=3/2)). After spraying and curing a resistivity of 3 $10^{11}$ Ohm/square was measured $Ti_xCr_yO_z$: 1.32 gr$TiAcAc_2$ was dissolved in 24 gr ethyleneglycol butyl ether together with 0.12 gr $CrAcAc_3$ (Ti/Cr=8/1). The resistivity of the layer was 1 $10^9$ Ohm/square.

The $CrAcAc_3$ itself gave a resistivity of 4 $10^9$ Ohm/square after application as layer.

Resistivity

Resistivity was measured with a Trek resistance meter. Model 152-1. Resistance is typically defined by R=U/I. Resistivity is determined by R=(U/l)/(I/d) where l is the length between contacting electrodes and D is the width between contacting electrodes, see FIG. 4. Resistivity or sheet resistance is a material property. As both (volumetric) resistance and resistivity both have the physical unit Ohm the resistivity is normally expressed as Ohm/square.

Gliding Behavior

Further, the gliding behavior of a number of coating materials (having one type of first metal ion and none or 1 type of second metal ion, and oxygen) was evaluated. This was done based on experimental work using tests irons having the below indicated coatings, wherein e.g. the combination Ti—O and Ce—O stands for a coating comprising a TiCeO oxide (mixed oxide or oxide mixture), and Co—O indicates a coating comprising only cobalt oxide.

Tests were performed ironing silk and the gliding behavior was evaluated from extremely draggy (−−−−−) via sufficient (+/−) to excellent gliding (+++++). The results are given in the next table.

| | No second metal | Ce—O | Mn—O | Co—O |
|---|---|---|---|---|
| Ti—O | + | ++++ | +++ | ++ |
| Zr—O | + | +++++ | +++ | ++ |
| Hf—O | + | ++ | ++ | ++ |
| Sc—O | +/− | | | |
| Y—O | +/− | + | + | + |
| Mn—O | −−−−− | | | |
| Ce—O | −−−−− | | | |
| Co—O | −−−−− | | | |

The results show that a coating comprising only the second metal ions manganese, cerium, or cobalt sticks to the silk garment, whereas coatings only comprising oxides of the first metal ions (Ti, Zr, Hf, Sc, Y), show sufficient to good gliding behavior. Adding second metal ions to the coating, however shows an improved gliding behavior, especially for the coatings comprising titanium and zirconium. The relatively best gliding behavior was obtained using either titanium or zirconium as first metal ion and cerium or manganese as second metal ion.

Amongst others, in view of the above, in embodiments, the (molar) ratio of second metal ions to first metal ions (in the metal oxide coating) is at least 0.005, such as at least 0.01, especially at least 0.015, more especially at least 0.05, such as at least 0.075, even more especially at least 0.15. In further embodiments, the ratio of second metal ions to first metal ions (in the metal oxide coating) is at maximum 5, such as at maximum 4, especially at maximum 3, even more especially at maximum 2. Especially, the metal oxide coating comprises a ratio of second metal ions to first metal ions selected in the range of 0.005-5. In embodiments, the metal oxide coating comprises a ratio of second metal ions to first metal ions selected in the range of 0.075-2. In other embodiments, the metal oxide coating comprises a ratio of second metal ions to first metal ions selected in the range of 0.005-1.

Especially, a ratio of the first metal ion to the second metal ion is selected from the range of 0.1-300, such as especially 0.2-300, such as 0.5-200, like 0.5-150.

Especially, the ratio of the first metal ion zirconium to a second metal ion is selected from the range of 0.2-150, such as 0.5-100.

Especially, the ratio of the first metal ion zirconium to the second metal ion cerium is selected from the range of 0.2-150, such as 0.5-100, like 0.75-75.

Especially, the ratio of the first metal ion zirconium to the second metal ion manganese is selected from the range of 0.2-150, such as 0.5-100, like 1.25-75.

Especially, the ratio of the first metal ion titanium to a second metal ion is selected from the range of 0.2-200, such as 0.5-150.

Especially, the ratio of the first metal ion titanium to the second metal ion cerium is selected from the range of 0.2-200, such as 0.5-150, like 1.25-150.

Especially, the ratio of the first metal ion titanium to the second metal ion manganese is selected from the range of 0.2-200, such as 0.5-150, like 2.0-75.

Hence, in embodiments of the coating, the ratio of zirconium:cerium (in the coating) is about 3:4, and especially providing good gliding properties. In other embodiments the ratio zirconium:manganese is about 4:3. In yet other embodiments, also providing good gliding properties, the ratio titanium:cerium is about 4:3. In yet other embodiments, the ratio titanium:manganese is about 8:3.

Advantageously, in other embodiments, a ratio first metal ions:second metal ions, especially zirconium:cerium or zirconium:manganese, was selected to be about 64:1 to provide a coating comprising a sheet resistance of about $1 \cdot 10^{10}$ Ω/square. In yet other embodiments, a ratio first metal ions:second metal ions, especially titanium:cerium or titanium:manganese, was selected to be about 128:1 to provide a coating comprising a sheet resistance of about $1 \cdot 10^{10}$ Ω/square.

Especially, the metal oxide coating of the invention may be provided by a sol-gel process (see further below). A sol-gel coating especially shows good properties such as good wear and scratch resistance, as well as good stain and especially this method may be a (material) cost saving method. Hence, especially, the metal oxide coating of the invention is a sol-gel metal oxide coating.

Further, the present coating can relatively easily be applied, such as if desired in one go. Beyond that, it is not inherently necessary to include a post polishing step after (sol-gel) application of the layer. This may for instance be necessary when a thick ceramic layer is applied like.

In embodiments, said metal oxide containing layer has a thickness less than 1 μm, preferable less than 400 nm to keep the transparency, and is especially a sol-gel coating. Such a nanolayer can keep the aesthetic appearance of the substrate, and also allows the retaining of other mechanical and thermal properties of the treatment plate, especially the contact surface, such as resistance to wear and fracture, and expansion coefficient. The coating may substantially cover the entire contact surface, although it is also possible that the coating is applied in a pattern of non-contiguous portions that partly cover the entire contact surface. Hence, the coating may in embodiments especially cover at least 80%, even more especially at least 90%, such as substantially all of the (contact) surface of the treatment plate.

In embodiments of the invention, the present treatment plate comprises a substrate having said contact surface comprising said coating, wherein said substrate is a metal, enamel, organic polymer, organo-silicate or silicate substrate.

In further embodiments, the treatment plate comprises a metal contact surface comprising said coating, especially said coating is directly applied onto said metal contact surface.

According to further embodiments, the treatment plate (comprising the coating, also) comprises a substrate (especially made of metal) comprising a substrate surface, and the plate further comprises at least one layer arranged (at the substrate), between said (substrate) surface and said coating wherein said layer is especially a metal composition, an enamel, organic polymer, organo-silicate or silicate layer. Such a layer is also expediently a sol-gel layer. Such layer arranged at the substrate and especially not contacting the garment in use is herein also indicated as "intermediate layer" or "intermediate coating layer" or "base layer" or "basis layer". This intermediate layer can be regarded as a layer between the substrate, especially a metal substrate, and the actual gliding layer (the coating of the invention). Alternatively, the combination of the gliding layer and an intermediate layer may also be regarded as a multi-layer coating. Especially, the term "multi-layer" coating may herein refer to a coating comprising the metal oxide coating according to the invention plus one or more intermediate coating layers. Especially, the treatment plate may comprise a multi-layer coating comprising the metal oxide coating (as described herein). Hence, in embodiments, the coating comprises a multi-layer coating comprising one or more layers selected from the group consisting of a metal layer, an enamel, an organic polymer comprising layer, an organo silicate comprising layer, a silicate comprising layer, and comprising said metal oxide coating (comprising the first and second metal) as outer layer. Hence, in embodiments, the contact surface may comprise said multi-layer coating.

Therefore, in specific embodiments the invention also provides a treatment plate for a garment treatment appliance, which treatment plate has a contact surface that in use slides on a garment being treated, wherein said contact surface comprises the sol-gel metal oxide coating comprising first metal ions selected from the group consisting of titanium, zirconium, hafnium, scandium and yttrium, especially titanium and/or zirconium, and second metal ions selected from the group consisting of cerium, manganese and cobalt, especially cerium, and wherein the treatment plate comprises a metal substrate and wherein the treatment plate further comprises at least one layer arranged between said metal substrate and said coating, said layer being a metal composition, an enamel, organic polymer, organosilicate or silicate layer.

In use, the contact surface (comprising the coating) glides on the garment being treated. Especially, the coating (comprising the metal oxide coating) described herein (i.e. the gliding layer) glides on the garment being treated. Especially, the coating is provided on a substrate, especially a metal substrate. Optionally, one or more additional layers may be arranged between the coating and the substrate (surface) (as discussed above).

Especially, such layer may comprise one or more layers selected from the group consisting of a metal layer, an enamel, an organic polymer comprising layer, an organo silicate comprising layer, a silicate comprising layer. Hence, in embodiments, the coating of the invention may contact the substrate directly. In other embodiments, the coating of the invention may be bound to the substrate indirectly via one or more (intermediate) layers as described above. Especially, a combination of oxides relates to a layer of oxides where different oxides are mixed and it can be observed and define which regions are belonging to which oxide. No (substantial) chemical reaction between the original oxides may have taken place.

Especially, a mixed oxide (see also below) may refer to a layer where the oxides are mixed at a molecular/atomic/ionic scale where it cannot be differentiate to be a single type of oxide. A material is then obtained wherein the ions of the (original) oxides are in the same (crystalline) lattice. An example of a mixed oxide is e.g. $Zr_3Ce_2O_z$ and an example of a combination of oxides is $MnO_2+ZrO_2$, or $Zr_3Ce_2O_z+Ti_8MnO_z$. The phrases "oxide mixture or mixed oxide thereof" or "oxide mixture or mixed oxide thereof" may thus refer to a mixture or combination thereof, such as a mixture of oxides or a mixed oxide. The phrase "wherein the coating comprises a mixed oxide comprising two or more of zirconium-cerium oxide, titanium-cerium oxide, zirconium-manganese oxide, and titanium-manganese oxide" does not exclude the presence of other (mixed) oxides.

According to other embodiments, said intermediate coating layer consists of a silicate layer wherein optionally said metal oxide, selected from zirconium-cerium oxide, titanium-cerium oxide, zirconium-manganese oxide, and titanium-manganese oxide and/or other first metal ions and second metal ions comprising oxides or a mixture or combination thereof, has been incorporated. Such intermediate layer may especially be obtainable by a sol-gel (coating) process. Thus, especially the intermediate coating layer-when available—is applied by a sol-gel coating process and the coating layer, such as described herein, is also applied by a sol-gel coating process.

Hence, the invention especially provides a treatment plate for a garment treatment appliance, which treatment plate has a surface with a (especially sol-gel) coating thereon, wherein the coating, especially the sol-gel coating, comprises a metal oxide, wherein the metal (of the metal oxide) comprising first metal ions selected from the group consisting of titanium, zirconium, hafnium, scandium and yttrium, especially titanium and/or zirconium, and second metal ions selected from the group consisting of cerium, manganese and cobalt, especially at least one metal oxide selected from the group consisting of zirconium-cerium oxide, titanium-cerium oxide, zirconium-manganese oxide, and titanium-manganese oxide. Such metal oxide especially is a mixed oxide or a mixture of mixed oxides. A mixed oxide contains cations of more than one chemical element or cations of a single element in several states of oxidation (or a combination thereof). Especially, in a mixed oxide there is substantially one material with the cations of the mixed oxide, such as e.g. zirconium and cerium, in the same lattice. In use, one face of such coating may slide on a garment being treated (the other face may be in contact with the support, or an intermediate layer).

Hence, in embodiments the term "metal oxide" may relate to a mixed metal oxide and/or a combination of mixed metal oxides and/or a combination of metal oxides. When mixing metal precursors from one solution, the final oxide layer obtained after application and drying may contain a mixture of metal oxides. Especially, it may (also) contain (a mixture of) mixed metal oxides. Furthermore, the final metal oxide layer can be crystalline, partly crystalline, or amorphous.

Hence, in embodiments, the invention provides the garment treatment appliance, wherein the metal oxide coating comprises a mixed oxide of the first metal ions and the second metal ions.

In further embodiments of the garment treatment appliance, the metal oxide coating comprises a mixture of an oxide of the first metal ions and an oxide of the second metal ions. Especially, the garment treatment appliance comprises the metal oxide coating, wherein the metal oxide coating has a layer thickness selected from the range of 50 nm-5 μm, especially 100 nm-1 μm.

In embodiments, the garment treatment appliance, especially the treatment plate, further comprise one or more support and control provisions selected from the group consisting of a steam supply, a heater, a temperature sensor, a control device to control the temperature of the treatment plate, and a control device to control the steam supply. Hence, especially the garment treatment appliance, especially the treatment plate, further comprises a heater for heating the treatment plate. In further embodiments, the garment treatment appliance further comprises a steam supply.

The term "substantially" herein, such as in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterizing features described in the description and/or shown in the attached drawings.

The various aspects discussed in this patent can be combined in order to provide additional advantages. Further, the person skilled in the art will understand that embodiments can be combined, and that also more than two embodiments can be combined. Furthermore, some of the features can form the basis for one or more divisional applications.

The above embodiments as described are only illustrative, and not intended to limit the technique approaches of the present invention. Although the present invention is described in details referring to the preferable embodiments, those skilled in the art will understand that the technique approaches of the present invention can be modified or equally displaced without departing from the scope of the technique approaches of the present invention, which will also fall into the protective scope of the claims of the present invention. In the claims, the word "comprising" does not exclude other elements or steps, and the indefinite article "a" or "an" does not exclude a plurality. Any reference signs in the claims should not be construed as limiting the scope.

The invention claimed is:

1. A treatment plate for a garment treatment appliance, the treatment plate having a contact surface that in use slides on a garment being treated, the contact surface comprising a coating comprising a metal oxide coating, the metal oxide coating comprising:

first metal ions selected from the group consisting of titanium (Ti), zirconium (Zr), hafnium (Hf), scandium (Sc), and yttrium (Y); and second metal ions are cerium (Ce) ions, wherein the coating comprises a multi-layer coating comprising at least one layer selected from the group consisting of a metal layer, an enamel, an organic polymer comprising layer, an organo silicate comprising layer, a silicate comprising layer, and comprising said metal oxide coating as outer layer.

2. The treatment plate according to claim 1, wherein the first metal ions are selected from the group consisting of titanium (Ti) and zirconium (Zr).

3. The treatment plate according to claim 1, wherein the first metal ions are zirconium (Zr) ions.

4. The treatment plate according to claim 1, wherein the metal oxide coating comprises a ratio of second metal ions to first metal ions of at maximum 2.

5. The treatment plate according to claim 1, wherein the metal oxide coating has a layer thickness selected from the range of 50 nanometers 5 micrometers.

6. The treatment plate according to claim 1, wherein the metal oxide coating is a sol-gel metal oxide coating.

7. The treatment plate according to claim 1, wherein the metal oxide coating has a sheet resistance equal to or lower than $1.10^{10}$ Ω/square.

8. A garment treatment appliance comprising a treatment plate as claimed in claim 1, wherein the garment treatment appliance is selected from the group of appliances consisting of an iron, a steam iron, and a steamer.

9. A treatment plate for a garment treatment appliance, the treatment plate having a contact surface that in use slides on a garment being treated, the contact surface comprising a coating comprising a metal oxide coating, the metal oxide coating comprising:

first metal ions selected from the group consisting of titanium (Ti), zirconium (Zr), hafnium (Hf), scandium (Sc), and yttrium (Y); and second metal ions selected from the group consisting of cerium (Ce), manganese (Mn), and cobalt (Co), wherein the coating comprises a multi-layer coating comprising at least one layer selected from the group consisting of a metal layer, an enamel, an organic polymer comprising layer, an organo silicate comprising layer, a silicate comprising layer, and comprising said metal oxide coating as outer layer, wherein the metal oxide coating comprises a ratio of second metal ions to first metal ions of at least 0.015.

10. The treatment plate according to claim 9, wherein the second metal ions are selected from the group consisting of cerium (Ce) and manganese (Mn).

11. The treatment plate according to claim 9, wherein the first metal ions are selected from the group consisting of titanium (Ti) and zirconium (Zr).

12. The treatment plate according to claim 9, wherein the metal oxide coating comprises a ratio of second metal ions to first metal ions of at maximum 2.

13. The treatment plate according to claim 9, wherein the metal oxide coating has a layer thickness selected from the range of 50 nanometers 5 micrometers.

14. The treatment plate according to claim 9, wherein the metal oxide coating is a sol-gel metal oxide coating.

15. A treatment plate for a garment treatment appliance, the treatment plate having a contact surface that in use slides on a garment being treated, the contact surface comprising a coating comprising a metal oxide coating, the metal oxide coating comprising:

first metal ions selected from the group consisting of titanium (Ti), zirconium (Zr), hafnium (Hf), scandium (Sc), and yttrium (Y); and second metal ions selected from the group consisting of cerium (Ce), manganese (Mn), and cobalt (Co), wherein the coating comprises a multi-layer coating comprising at least one layer selected from the group consisting of a metal layer, an enamel, an organic polymer comprising layer, an organo silicate comprising layer, a silicate comprising layer, and comprising said metal oxide coating as outer layer, wherein the metal oxide coating comprises a ratio of second metal ions to first metal ions of at least 0.075.

16. The treatment plate according to claim 15, wherein the first metal ions are selected from the group consisting of titanium (Ti) and zirconium (Zr).

17. The treatment plate according to claim 15, wherein the metal oxide coating comprises a ratio of second metal ions to first metal ions of at maximum 2.

18. The treatment plate according to claim 15, wherein the metal oxide coating has a layer thickness selected from the range of 50 nanometers-5 micrometers.

19. The treatment plate according to claim 15, wherein the metal oxide coating is a sol-gel metal oxide coating.

20. A method of providing a treatment plate for a garment treatment appliance, the treatment plate having a contact surface that in use slides on a garment being treated, the method comprising the step of providing on at least part of the contact surface a metal oxide coating, wherein the metal oxide coating comprises:

first metal ions selected from the group consisting of titanium (Ti), zirconium (Zr), hafnium (Hf), scandium (Sc), and yttrium (Y); and second metal ions are cerium (Ce), wherein the method comprises providing a precursor of the metal oxide coating to said surface to provide a deposition and curing the deposition to provide said metal oxide coating.

* * * * *